US007031226B2

(12) United States Patent
Farine

(10) Patent No.: US 7,031,226 B2
(45) Date of Patent: Apr. 18, 2006

(54) ELECTRONIC TIMEPIECE INCLUDING A GAME MODE

(75) Inventor: Pierre-André Farine, Neuchâtel (CH)

(73) Assignee: Asulab S.A., Marin (CH)

( * ) Notice: Subject to any disclaimer, the term of this patent is extended or adjusted under 35 U.S.C. 154(b) by 201 days.

(21) Appl. No.: 10/621,407

(22) Filed: Jul. 18, 2003

(65) Prior Publication Data

US 2004/0013042 A1 Jan. 22, 2004

(30) Foreign Application Priority Data

Jul. 19, 2002 (CH) ..... 1267/02

(51) Int. Cl.
*G04B 47/00* (2006.01)
*G04B 19/04* (2006.01)

(52) U.S. Cl. ..... 368/10; 368/238

(58) Field of Classification Search ..... 368/10, 368/223, 228, 238
See application file for complete search history.

(56) References Cited

U.S. PATENT DOCUMENTS 4,228,534 A 10/1980 Fellrath et al.
4,257,115 A 3/1981 Hatuse et al.
4,285,517 A * 8/1981 Morrison ..... 463/9
5,079,726 A * 1/1992 Keller ..... 702/142
5,453,960 A 9/1995 Teres et al.
6,463,011 B1 * 10/2002 Christen et al. ..... 368/69
6,527,610 B1 * 3/2003 Hornsby et al. ..... 446/175

FOREIGN PATENT DOCUMENTS

CH 684456 A3 9/1994
EP 1 122 620 A1 8/2001
GB 2 205 180 A1 11/1988
GB 2315709 A 2/1998

* cited by examiner

*Primary Examiner*—Andrew H. Hirshfeld
*Assistant Examiner*—Leo T. Hinze
(74) *Attorney, Agent, or Firm*—Sughrue Mion, PLLC

(57) ABSTRACT

There is disclosed an electronic multi-function wristwatch one of whose operating modes is a memory game which uses the time display means of the watch. In the preferred version comprising an analogue time display, the watch randomly generates a sequence of visual indications such as time values and displays it by means of the hands (3, 4). Then, the player attempts to repeat these indications by entering a sequence of answers by means of control keys (14–19) arranged facing the hour symbols (7) of the dial. These keys preferably comprise electrodes affixed under the watch glass. The watch displays successive sequences each comprising one or more indications more than the preceding sequence. It can also emit corresponding sequences of sounds. The watch/user interface can further comprise push-buttons (11–13) and an alphanumerical LCD display (9).

17 Claims, 4 Drawing Sheets

ELECTRONIC TIMEPIECE INCLUDING A GAME MODE

BACKGROUND OF THE INVENTION

The present invention concerns an electronic timepiece, particularly a wristwatch, including a game mode using the time display means. The invention also concerns a method for using an electronic timepiece for playing such a game.

Electronic watches provided with one or more game operating modes are known. For example, GB Patent Application No. 2 205 180 discloses a watch provided with a digital display capable of displaying a table of numbers like those of a game of lottery, and of carrying out and displaying a random draw of the numbers. By acting on the control push-buttons of the watch, the user can control the game and also pre-select parameters such as the range of numbers to be considered and the number of numbers to be drawn.

In CH Patent No. 684 456, there is disclosed an electronic chronograph watch provided with a lottery mode of the same type and having an analogue display for indicating the time and a liquid crystal digital display for displaying the numbers of a lottery draw. The push-buttons of the chronograph are also used as control means for entering data in game mode.

Although the game of lottery is very popular, the implementation thereof in a watch is much less interesting than the real game of lottery carried out collectively, since it is the fact of playing collectively that allows high winnings forming the main attraction of the game.

SUMMARY OF THE INVENTION

It is an object of the present invention to incorporate in a timepiece, in particular a wristwatch, a game that has the same level of interest even if a single player plays it. A particular object consists in using certain of the members, intended for the normal functions of the timepiece, for the game, so as to be able to incorporate the game in an electronic watch with the least possible additional components.

According to a first aspect of the invention, there is provided an electronic timepiece including a game mode and having display means capable of displaying the time, which are controlled by an electronic unit provide with storage means, the timepiece further including manual control means allowing a user to enter data into the electronic unit, and being characterised in that the game mode is a memory game mode, in which the electronic unit generates, stores and temporarily displays one or more visual indications by the display means, then the user provides answers trying to reproduce said indications using manual control means and the electronic unit compares said answers to said stored indications.

The idea of integrating such a memory game in a personal object such as a watch is advantageous in that this game can be played individually or by several players without the game losing any of its interest. Insofar as the game consists of storing time values, i.e. numbers capable of being displayed by the ordinary display members of a timepiece, an extra display member is not indispensable. Likewise, when the watch is already provided with several control members, as is the case of chronograph watches and multi-function watches, the game can be integrated in the watch without any extra control members. In the best case, the game can be integrated in the timepiece simply by incorporating specific software in the microprocessor that manages the functions of the electronic timepiece.

According to a second aspect of the invention, there is provided a method for using an electronic timepiece as a memory game, the timepiece comprising display means capable of displaying the time, which are controlled by an electronic unit provided with storage means, the timepiece further including manual control means allowing a user to enter data into the electronic unit, and characterised in that in a first phase of the memory game, the electronic unit generates, stores and temporarily displays one or more visual indications via the display means, and in a following phase the user provides answers attempting to reproduce said visual indications using manual control means and the electronic unit compares said answers to said stored indications.

BRIEF DESCRIPTION OF THE DRAWINGS

Other features and advantages of the present invention will appear in the following description of a preferred embodiment and a variant, presented by way of non-limiting example with reference to the annexed drawings, in which.

DETAILED DESCRIPTION OF THE INVENTION

Figure 1:
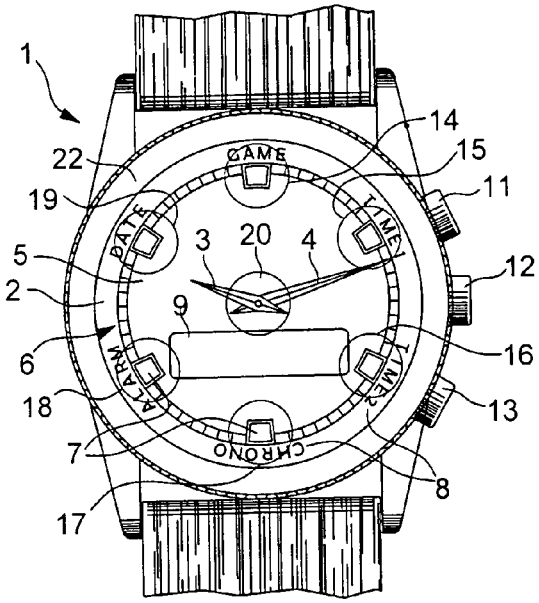
FIG. 1 is a top view of a multi-function wristwatch in which the present invention is implemented in accordance with a preferred embodiment, the watch display means being shown in a time display mode.

Electronic wristwatch 1 shown in FIG. 1 is a multi-function watch provided with an analogue display and a digital display, which are arranged below the glass 2 of the watch. The analogue display comprises an hour hand 3 and a minute hand 4, which are driven individually, each by an electric motor with two rotational directions. Hands 3 and 4 rotate above a dial 5 carrying a scale 6 completed by hour symbols 7, which are six in number in this example and which correspond respectively to 2, 4, 6, 8, 10 and 12 o'clock, and operating mode symbols 8 which, in this example are also six in number and each formed by the name of the corresponding mode. The digital display comprises an alphanumerical liquid crystal display cell (LCD) 9 placed in an aperture of dial 5.

The control means of watch 1 include three push-buttons 11, 12 and 13, which can be arranged in a conventional manner on the middle part of the watchcase, and seven control keys 14 to 20, which, in this example, are formed by transparent electrodes affixed under glass 2. The six keys 14 to 19 are arranged above the six hour symbols 7 and the six mode symbols 8, juxtaposed with the latter, so that the user knows that activating one of these keys corresponds to the hour or mode symbols visible behind the key. The seventh key 20 is located at the centre of glass 2, above the shafts of hands 3 and 4.

Keys 14 to 20 are capacitive type keys, that the user activates by placing the end of his finger on the outer face 2 of glass 2 facing the selected key, the watch containing a circuit capable of detecting the variation in capacitance thereby created between the key electrode and earth. For a detailed description of such a capacitive key control system, the reader can refer, for example, to Patent publication Nos. U.S. Pat. No. 4,228,534, U.S. Pat. No. 4,257,115, U.S. Pat. No. 5,453,960 and EP 1 122 620. It will be noted, however, that within the scope of the present invention, these keys can be replaced by other control members placed facing symbols 7, for example keys or buttons placed on the watchcase bezel 22, as provided, for example, in GB Patent Application No. 2 315 709.

Figure 9:
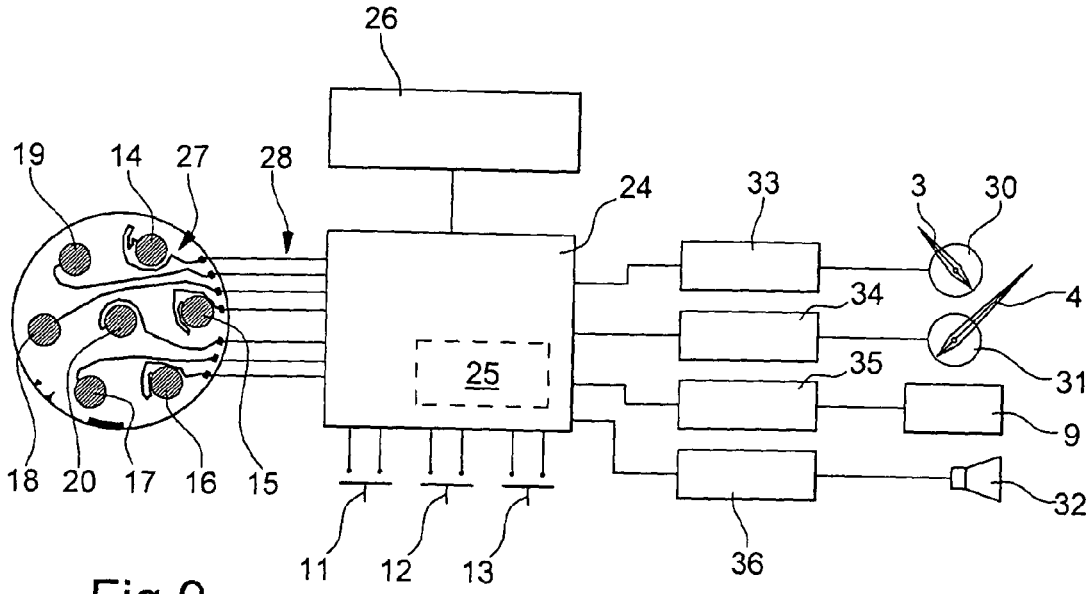
FIG. 9 is a flowchart of the main members of the watch that are used to implement the memory game.

FIG. 9 shows schematically how the display and control means described above are connected to a microprocessor 24 provided with storage means 25. Microprocessor 24 is associated with a time base 26 such as a quartz resonator to form the timekeeper of the watch. It contains software allowing it to control not only the time functions, but also all the other functions of watch 1. It is connected to seven electrodes 14 to 20 via a set of transparent conductive paths 27 affixed under glass 2 and a set of electrical connections 28 connecting the glass to the microprocessor in the watchcase. A pair of conductors connects each of push-buttons 11 to 13 to microprocessor 24. Microprocessor 24 controls the two motors 30 and 31 driving hands 3 and 4, and digital display 9 and an electro-acoustic transducer 32, through respective drive circuits 33, 34, 35 and 36.

The six operating modes represented by symbols 8 are as follows:

| | |
|---|---|
| TIME 1: | time display of the local time zone via the hands |
| TIME 2: | additional time display of a second time zone on LCD display |
| CHRONO: | chronograph mode |
| ALARM: | alarm mode |
| DATE: | date indication via LCD display |
| GAME: | game mode |

The first five aforementioned modes are well known in electronic multi-function watches. Certain of them are implemented, for example, in the watch marketed under the trademark Tissot T-Touch®, which comprises the structure illustrated by FIG. 9.

The addition of the game mode to this watch only requires storing specific software in the microprocessor, affixing the symbol GAME on the dial and perhaps changing LCD display 9 and its drive circuit 34 to widen the alphanumerical display zone.

Figure 10:
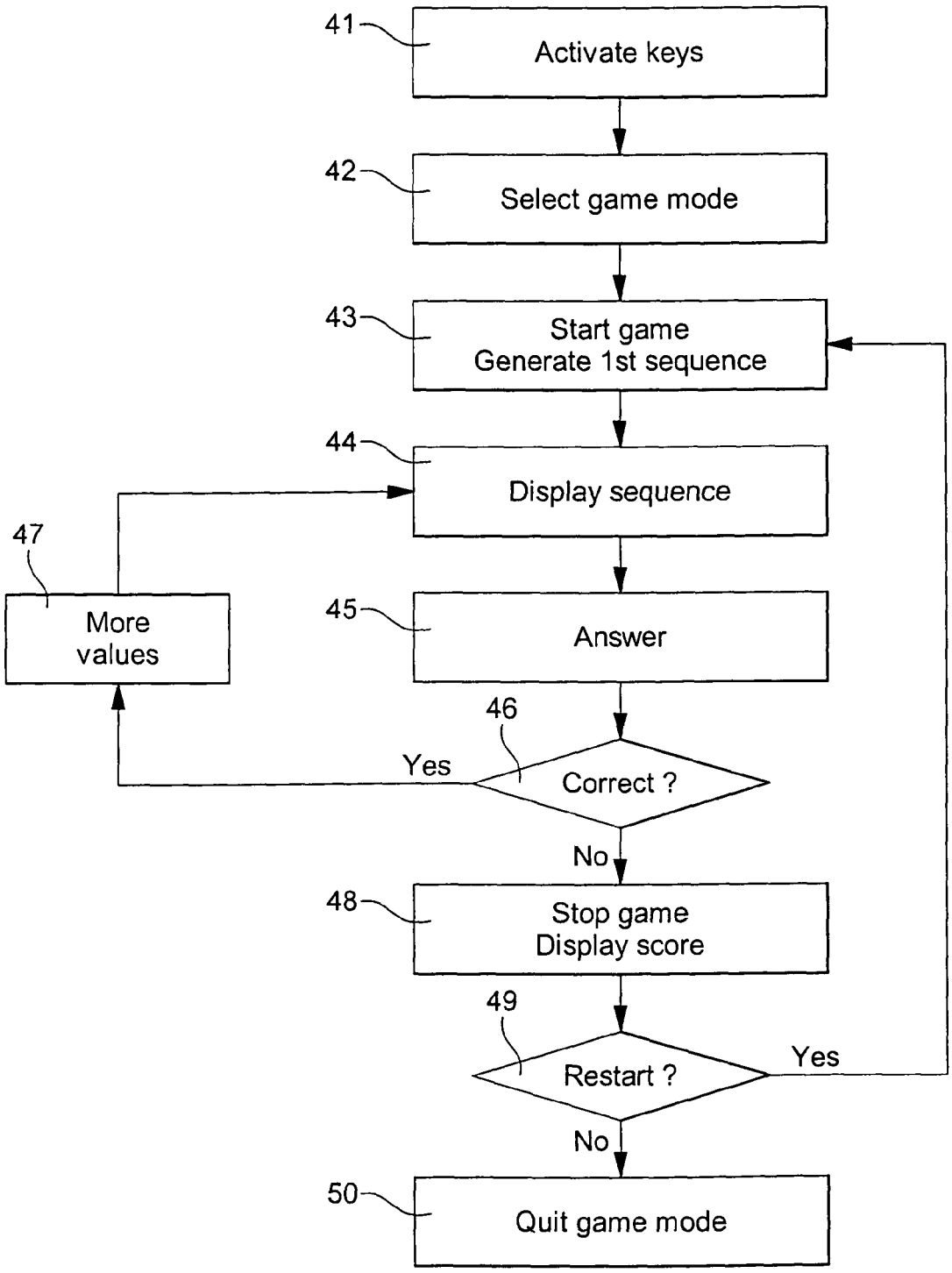
FIG. 10 is a diagram of the steps of an embodiment of the memory game.

The memory game sequence will now be described with reference to the step diagram of FIG. 10 and to the various states of the display members shown in FIGS. 1 to 8.

It is assumed that before the game the watch is in its standard mode TIME 1 and that capacitive control keys 14 to 20 are inactive. Step 41 consists in pressing median button 12 to activate these keys, such that they are cyclically monitored by microprocessor 24 by means of the aforementioned detection circuit. The display does not change, except that a flashing symbol is added to LCD display 9 to indicate that the keys are active.

Figure 2:
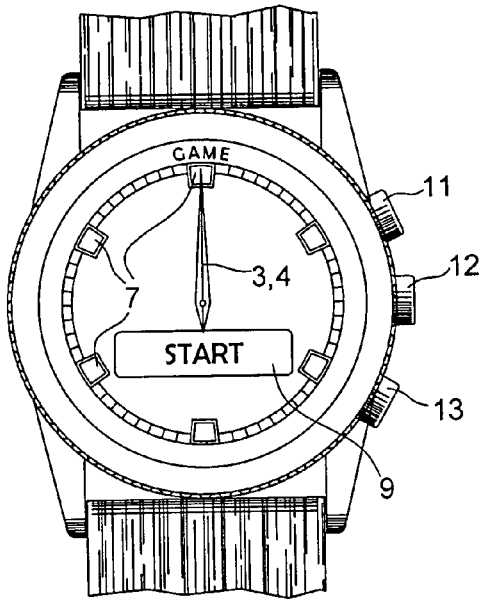
FIGS. 2 to 8 show different states of the watch display during the memory game.

In step 42, the player places his finger facing the GAME symbol, which activates the corresponding key 14 and puts the watch in game mode. As FIG. 2 shows, hands 3 and 4 acknowledge this command by placing themselves one on top of the other facing the GAME symbol, which his at 12 o'clock in this example. LCD display 9 then displays a scroll down menu which indicates various ways of playing and that the player can scroll down by activating key 14 several times. Certain of the terms of this menu include game settings, such as for example the number of players, the degree of difficulty of the game, switching an acoustic device on or off, etc., and the player can select values for these settings by means of push-buttons 11 and 13. The acoustic device uses electro-acoustic transducer 32 incorporated in the watch and can emit different notes corresponding for example to each hour symbol 7 and to the associated keys 14 to 19. Thus, microprocessor 24 can be programmed to control the emission of a sequence of various sounds, which correspond to the various time values of a sequence during display of the sequence, such that the memory game is both visual and musical. The game can even be placed solely by hearing, if the player decides to aim to reproduce the sequence of sounds that he has just heard and thus does not look at the display of the sequence offered by the watch. A command for omitting the display of said sequence via the hands can also be provided in the scroll down menu, so that the watch offers it only acoustically.

In order to simplify the description, the example presented here is a game for a single player and the range of numerical values, in this case time values, that the watch displays and that the player has to repeat includes only the values 2, 4, 6, 8, 10 and 12 which are symbolised on the dial by the six hour symbols 7 and are indicated by the two hands 3 and 4 superposed facing the corresponding symbol.

The menu includes a START command which automatically starts the game when it has been displayed for more than three seconds. This automatic start constitutes step 43, where microprocessor 24 randomly generates a first sequence of time values and stores it in its memory 25. This first sequence can comprise a single time value or several, as a function of the settings selected by the player. It is assumed here that the first sequence comprises three time values. Of course, a sequence contains the same value several times.

Figure 3:
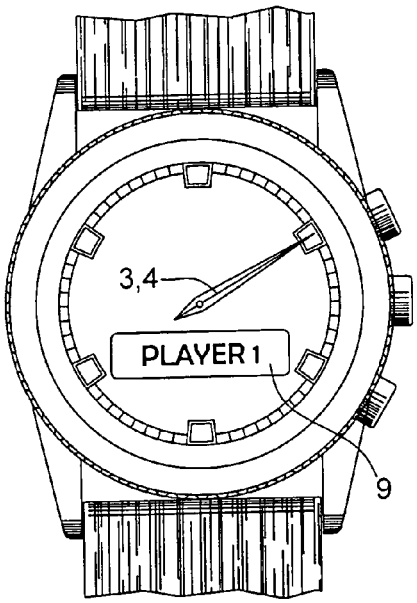
Figure 4:
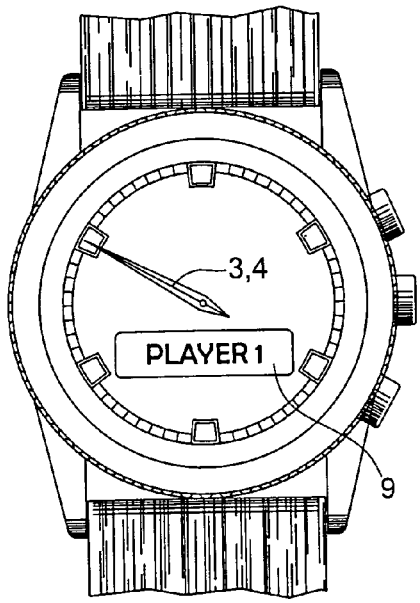
Figure 5:
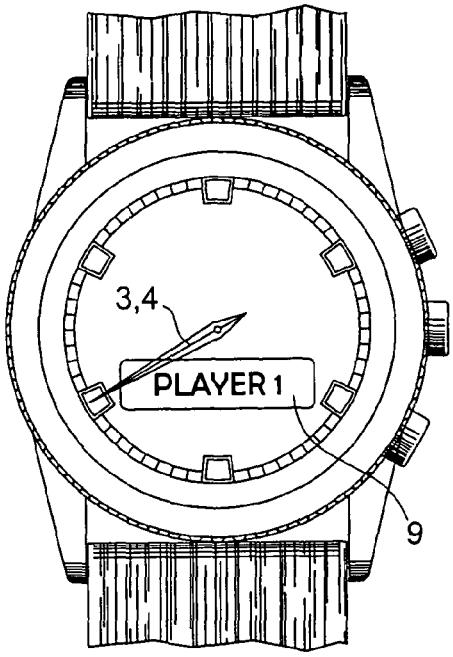
Figure 6:
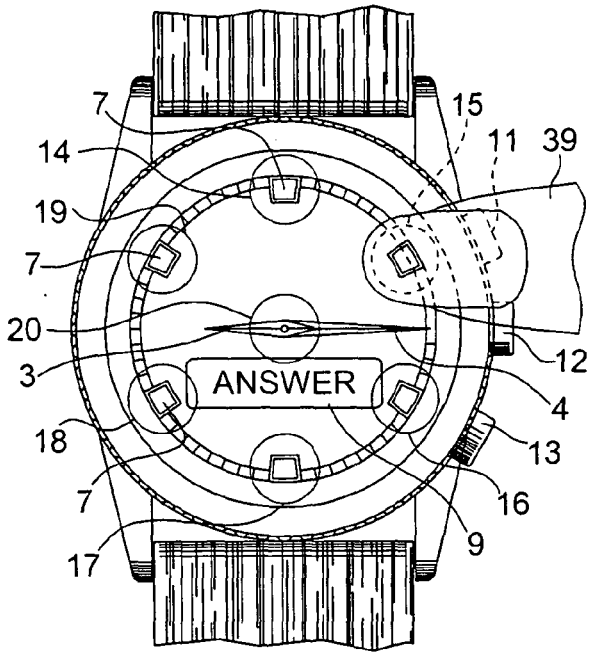

In step 44, microprocessor 42 temporarily and successively displays all the values of the sequence by means of superposed hands 3 and 4 as shown in FIGS. 3, 4 and 5, where it can be seen that these three values are 2–10–8 considering the hour scale on the dial. The message PLAYER 1 on LCD display 9 indicates the number of the player. Next, the hands are placed horizontally to indicate that the sequence has finished, as FIG. 6 shows, and the LCD display gives the message ANSWER to invite the player to answer.

Figure 7:
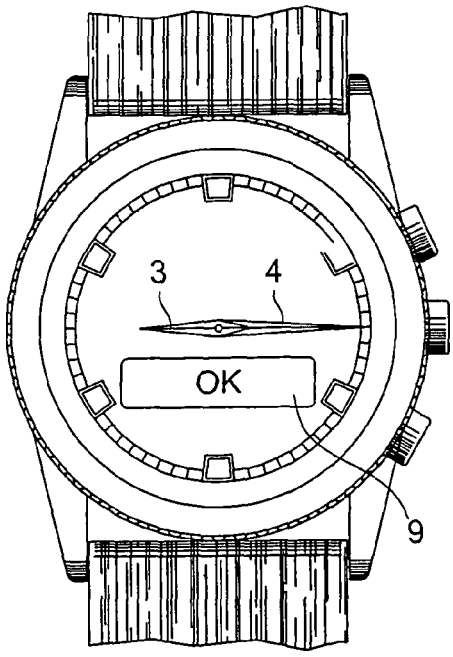

In step 45, the player gives a sequence of answers by placing his finger 39 successively on those keys 14 to 19 which correspond to the sequence that the watch has just displayed. The hands acknowledge each answer by placing themselves opposite the corresponding symbol 7. At the same time, in step 46, microprocessor 24 compares each answer with the corresponding stored value. If the whole sequence of answers is correct, the microprocessor passes to step 47, which consists in randomly drawing one or more additional time values, depending on the degree of difficulty selected, and storing them after those of the preceding sequence to form the next sequence, whereas the LCD display gives an OK message as shown in FIG. 7 to indicate that the sequence of answers was correct. The game then returns to sequence display step 44. The game then continues in the same way as for the preceding sequence.

Figure 8:
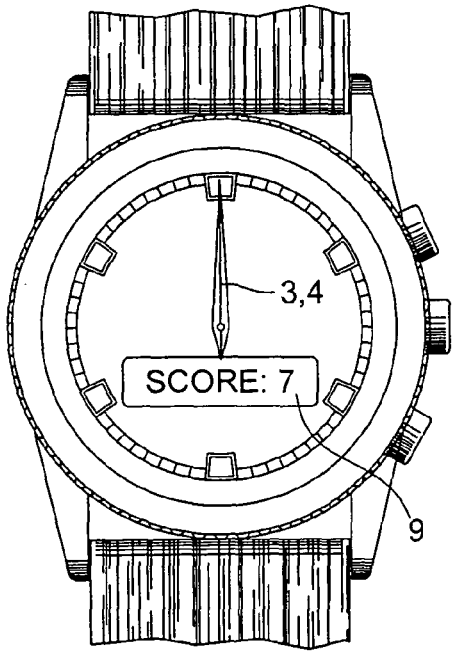

As soon as the player gives a wrong answer, microprocessor 24 stops the game in step 48 and displays the state shown in FIG. 8, where the LCD indicates a score which is the number of values contained in the last correct sequence of answers.

The display provided in step 48 is held for a definite time. In step 49, if, during this time period, the player carries out a command on the key 14 corresponding to GAME, the microprocessor returns to step 43 to automatically restart the game. During the time holding period, the player can activate another key or a push-button to pass to another mode of the watch. If no command is carried out, the microprocessor passes to the final step 50 consisting in returning to the initial mode of the watch.

The reader will understand that the very simple game mode described hereinbefore can be subject to more complicated variants, for example if the game uses the twelve usual hour symbols of a watch with twelve corresponding keys, and/or if the time values of the game are given in hours and minutes by means of the two hands 3 and 4, like the conventional time display. Moreover, the field of application of the invention is not limited to analogue display timepieces, since display of the time value sequences randomly selected by the microprocessor can equally well be carried out in a digital or even a graphic manner, for example in the form of visual indications such as symbols, if allowed by the display screen. Introduction of the answer sequences can then be carried out in any appropriate manner, for example by means of a touch screen or push-buttons, as is usually the case for entering an alarm time in multi-function digital display watches. However, the analogue display associated with keys close to the hour symbols on the dial is preferred because it constitutes a particularly user-friendly interface between the timepiece and the user. Of course, the hour symbols can be formed by figures.

It will also be noted that the alphanumerical display 9 described hereinbefore is not indispensable, since these indications could be displayed by particular combinations of the positions and/or movements of hands 3 and 4 and any additional hands. For example, one of hands 3 and 4 could point to a function symbol affixed to the dial, whereas the other hand would oscillate to indicate that that function is proposed. Driving the hands by means of two independent two-directional motors allows multiple variants of this kind.

Figure 11:
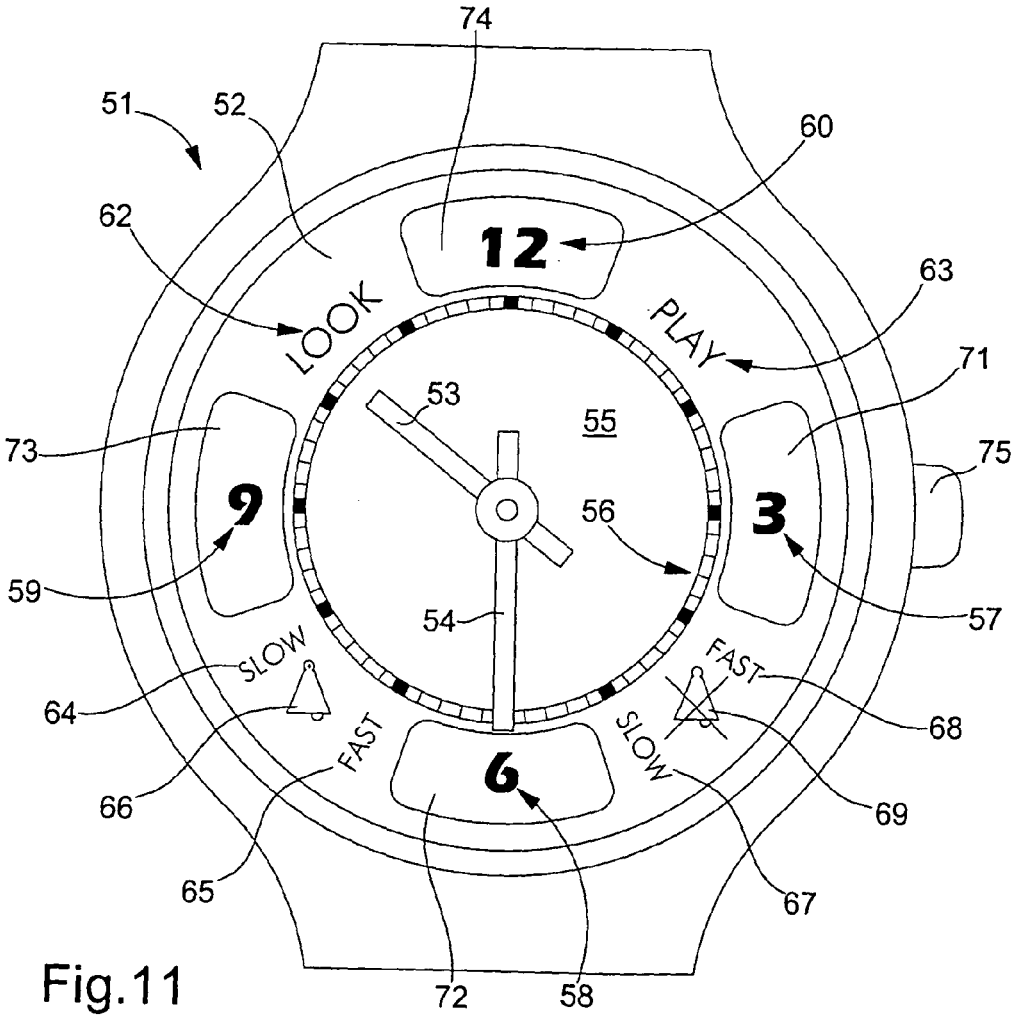
FIG. 11 is a similar view to FIG. 1, illustrating a variant.

FIG. 11 illustrates a variant which differs from the preceding example in its display means, digital display 9 being omitted, and in its control means, push-buttons 11, 2 and 13 being replaced by a multi-function control stem.

As in the preceding example, watch 51 shown in FIG. 11 includes, below watch glass 52, an hour hand 53 and a minute hand 54, which are driven individually by electric motors with two rotational directions. Hands 53 and 54 rotate above a dial 55 bearing a time scale 56 completed by hour symbols 57, 58, 59 an 60, in this case the numbers 3, 6, 9 and 12 representing the four values (time-related or otherwise) which will be used in the game. In this example, hour symbols 57 to 60 are affixed to the glass rather than to the dial.

Dial 55 further bears function symbols 62 and 63, intended to represent the two main phases of the game. The symbol 62 (LOOK) indicates to the player that he has to observe the sequence of values displayed by the watch during the first phase of the game. The symbol 63 (PLAY) indicates to the player that he has to give a sequence of answers.

Dial 55 also bears mode symbols 64 to 69. Symbols 64 and 69 (SLOW) indicate a slow game mode, whereas symbols 65 and 68 (FAST) indicate a fast game mode. Symbol 66 placed between the two symbols 64 and 65 indicate that the game modes represented thereby include the emission of various sounds during the game, by means of an electro-acoustic transducer similar to transducer 32 described in the preceding example. Conversely, crossed-out symbol 69 indicates that the two symbols 67 and 68 represent game modes without any emission of sound. Thus, symbols 64, 65, 67 and 68 respectively represent four different game modes.

The watch control means 51 include, as in the preceding example, capacitive control keys 71 to 74, which are formed by non-transparent electrode affixed under glass 52, below the four symbols 57 to 60. These electrodes can be made by means of a conductive paint. The push-buttons of the preceding example are replaced here by an electric control pusher-stem 75, including a crown outside the watchcase able to rotate and occupy four axial positions. When stem 75 is pushed in from its neutral position, it closes an electric contact, and then returns to the neutral position via the effect of a spring. A first pulled-out position of stem 75 puts the two hands 53 and 54 in a superposed position and allows them to be moved together by rotating the stem, particularly to select a game mode. A second pulled-out position of the stem allows the time to be set. The arrangement of such a four-position control stem for controlling an electronic watch is well known and allows other additional functions to be controlled via different combinations of actions on the stem.

The diagram of the electronic means of watch 51 can be similar to that of FIG. 9, omitting elements 9 and 35 and replacing the contacts of pushers 11 to 13 with contacts activated by the appropriate movements of stem 75.

A way of playing the memory game on watch 51 shown in FIG. 11 will now be described. As the watch is initially in time display mode, the player has to first of all select play mode by putting stem 75 into its first pulled-out position, such that the two hands 53 and 54 are superposed and are positioned for example at 6 o'clock. The player selects one of the play modes represented by the symbols 64, 65, 67 and 68 by rotating stem 75 until the superposed hands are facing the desired symbol. He then pushes the stem back into its neutral position, and then activates capacitive keys 71 to 73 by briefly pushing the stem. The game then starts automatically and proceeds as in the preceding example, except as regards the display.

In the first phase in which the microprocessor generates, stores and displays a sequence of values corresponding to certain of symbols 57 to 60, for example 6–9, hour hand 53 points to function symbol 62 (LOOK), whereas minute hand 54 temporarily and successively points to symbols 58 and 59 to indicate the sequence to be memorised to the player. The hand display is then as shown in FIG. 11. If an acoustic mode has been selected, the display of each value is accompanied by the emission of a corresponding note by the electro-acoustic transducer (buzzer). Then hour hand 53 points to function symbol 63 (PLAY) to indicate entry into the answer phase. The player attempts to reproduce the sequence by placing a finger on the keys 72 and 73 corresponding to values 6–9. If the sequence of answers is correct, the watch returns to the first phase adding a value to the sequence, which becomes, for example, 6–9–6, and the game continues. If the answer is wrong, the two hands move to a superposed position and temporarily indicate on scale 56 a score comprised between 0 and 59, corresponding to the number of successful sequences during the game, then the watch returns to time display mode. All through the game, the watch returns to time display mode if the player does not act on the control means for a given period of time, for example 10 seconds.

Of course, watch 51 could include other game modes in addition to or instead of the four modes described hereinbefore, for example a mode in which each sequence is different to the preceding sequence.

In a variant that is not shown, the numerical hour symbols 57 to 60 of watch 51 could be replaced by any other type of graphic element, such as drawings or symbols, or by visible marks formed by projecting parts on the glass. They could also be omitted provided the electrodes of capacitive keys 71 to 74 are visible, for example coloured, and be used as indices for identifying the visual indications formed by the respective positions of hand 54 facing the electrodes.

What is claimed is:

1. A electronic timepiece, particularly a wristwatch, including a game mode and having display means including an analogue time display comprising hour symbols and at least two hands for displaying the time, said display means being controlled by an electronic unit provided with storage means, the timepiece further including manual control means allowing a user to enter data into said electronic unit, wherein the game mode is a memory game mode, wherein said electronic unit generates, stores and temporarily displays one or more visual indications via at least one of said hands, then the user provides answers attempting to reproduce said indications using said manual control means, and said electronic unit compares said answers to said stored indications.

2. The timepiece of claim 1, wherein said visual indications are numerical values and wherein in the game mode said electronic unit randomly generates at least a first sequence of one or more numerical values and temporarily displays said sequence, then the user provides a sequence of answers consisting in successively reproducing said numerical values of the first sequence, said electronic unit compares the answers to the stored values and displays an indication as to the result of the comparison at least if the sequence of answers is not identical to the sequence of stored values.

3. The timepiece of claim 2, wherein when the result of the comparison indicates that the sequence of answers is identical to the sequence of stored values, said electronic unit generates and stores a next sequence of numerical values, then the user provides a new sequence of answers, said electronic unit compares said answers to said stored values and displays an indication as to the result of the comparison at least if the sequence of answers is not identical to the sequence of stored values, and so on.

4. The timepiece of claim 1, wherein said manual control means include control keys arranged in registration to at least certain of said hour symbols.

5. The timepiece of claim 4, wherein said control keys are formed by electrodes arranged against a glass of the timepiece and facing the corresponding hour symbols.

6. The timepiece of claim 4, further including an alphanumerical display used for displaying messages relating to the progress of the game.

7. The timepiece of claim 4, wherein said visual indications are time values and wherein the time value display in the game mode is achieved by positioning at least one of said hands facing one of said hour symbols.

8. The timepiece of claim 7, wherein the display of said time values in the game mode is achieved by means of hour and minute hands like a conventional time display.

9. The timepiece of claim 4, wherein said display means include function symbols, one of the hands being positioned facing one of the function symbols during the temporary display phase of one or more visual indications, then facing another of the function symbols while the user provides a sequence of answers.

10. The timepiece of claim 1, including an electroacoustic transducer controlled by said electronic unit and arranged to emit, during display of said visual indications, various sounds that correspond to the various visual indications displayed.

11. The timepiece of claim 1, wherein said electronic unit is arranged for determining and displaying results of the memory game for different players.

12. A method of using an electronic timepiece as a memory game, the timepiece including display means comprising hands for displaying the time, which are controlled by an electronic unit provided with storage means, the timepiece further including manual control means allowing a user to enter data into said electronic unit, wherein in a first phase of the memory game, said electronic unit generates, stores and temporarily displays one or more visual indications via at least one of said hands, then the user provides answers attempting to reproduce said indications using said manual control means, and said electronic unit compares said answers to said stored indications.

13. The method of claim 12, wherein, in said first phase, said electronic unit randomly generates at least a first sequence of one or more visual indications, stores it in the storage means and temporarily display it via said hands, then the user provides a sequence of answers consisting in successively reproducing said visual indications of the first sequence with said manual control means, said electronic unit compares said answers to the stored indications and displays an indication as to the result of the comparison at least if the sequence of answers is not identical to the sequence of stored indications.

14. The method of claim 13, wherein when the result of the comparison indicates that the sequence of answers is identical to the sequence of stored indications, said electronic unit generates, stores and temporarily displays a next sequence of visual indications, then the user provides a new sequence of answers, said electronic unit compares said answers to the stored indications and displays an indication as to the result of the comparison at least if the sequence of answers is not identical to the sequence of stored indications, and so on.

15. The method of claim 14, wherein said next sequence comprises at least one visual indication more than the preceding sequence.

16. The method of claim 15, wherein said next sequence is generated by adding at least one extra visual indication to those of the preceding sequence.

17. The method of claim 12, wherein, during the display of the visual indications, the timepiece emits various sounds which correspond to the various visual indications displayed, respectively.

* * * * *